US010365049B2

(12) United States Patent
Tso et al.

(10) Patent No.: US 10,365,049 B2
(45) Date of Patent: Jul. 30, 2019

(54) PASSIVE THERMAL DIODE

(71) Applicant: The Hong Kong University of Science and Technology, Kowloon, Hong Kong (CN)

(72) Inventors: Chi Yan Tso, Hong Kong (CN); Christopher Yu Hang Chao, Hong Kong (CN)

(73) Assignee: The Hong Kong University of Science and Technology, Hong Kong (CN)

( * ) Notice: Subject to any disclaimer, the term of this patent is extended or adjusted under 35 U.S.C. 154(b) by 18 days.

(21) Appl. No.: 15/744,101

(22) PCT Filed: Jul. 14, 2016

(86) PCT No.: PCT/CN2016/089954

§ 371 (c)(1),
(2) Date: Jan. 12, 2018

(87) PCT Pub. No.: WO2017/008748

PCT Pub. Date: Jan. 19, 2017

(65) Prior Publication Data

US 2018/0202726 A1 Jul. 19, 2018

Related U.S. Application Data

(60) Provisional application No. 62/231,701, filed on Jul. 14, 2015.

(51) Int. Cl.
*F28F 13/00* (2006.01)
*F28F 27/00* (2006.01)

(52) U.S. Cl.
CPC ..... *F28F 13/00* (2013.01); *F28F 27/00* (2013.01); *F28F 2013/008* (2013.01); *F28F 2255/04* (2013.01)

(58) Field of Classification Search
CPC ..... F25D 19/006; F28F 2013/005; F28F 2013/008; F28F 13/00; F28F 27/00; F28F 2255/04
See application file for complete search history.

(56) References Cited

U.S. PATENT DOCUMENTS 4,281,708 A 8/1981 Wing et al.
8,570,043 B2 * 10/2013 Jiang ..... F25D 19/00 324/319
2010/0113282 A1 * 5/2010 Kawashima ..... F25D 19/006 505/163

FOREIGN PATENT DOCUMENTS

CN 103063081 A 4/2013
DE 3820736 A1 * 12/1989 ..... F28F 13/00
(Continued)

OTHER PUBLICATIONS

Marucha, Cz. et al., "Heat Flow Rectification in Inhomogeneous GaAs"; Institute for Low Temperature and Structure Research, Polish Academy of Sciences; pp. 269-273; Jul. 3, 1975 (5 pages).
(Continued)

*Primary Examiner* — Eric S Ruppert
(74) *Attorney, Agent, or Firm* — Osha Liang LLP

(57) ABSTRACT

A passive thermal diode (10), comprising: a heat source (12); a heat sink (14); a thermal coupling element (16) removably coupled to the heat source (12) and the heat sink (14); a lever (18), the lever (18) connected to the thermal coupling element (16) via a pivot point (19); and at least one spring (20) connected to the lever (18), the spring (20) comprised of a shape memory alloy, wherein the lever (18) transmits a force to displace the thermal coupling element (16) when the force is produced by the spring (20) on the lever (18).

22 Claims, 8 Drawing Sheets

(56) References Cited

FOREIGN PATENT DOCUMENTS

| | | | |
|---|---|---|---|
| JP | 2001085220 A | * | 3/2001 |
| JP | 2012209381 A | * | 10/2012 |

OTHER PUBLICATIONS

Jezowski, A. et al., "Heat Flow Asymmetry on a Junction of Quartz with Graphite"; Institute for Low Temperature and Structure Research, Polish Academy of Sciences; pp. 229-232; Feb. 8, 1978 (4 pages).
Jones, A. M. et al., "Thermal Rectification Due to Distortions Induced by Heat Fluxes Across Contacts Between Smooth Surfaces"; Journal Mechanical Engineering Science, vol. 17, No. 5; pp. 252-261; 1975 (10 pages).
Office Action issued in corresponding Chinese Application No. 201680041425.4 dated Apr. 15, 2019 (11 pages).

* cited by examiner

PASSIVE THERMAL DIODE

CROSS-REFERENCE TO RELATED APPLICATION

This application claims priority under 35 USC § 119 to U.S. Provisional Application Ser. No. 62/231,701 filed on Jul. 14, 2015. U.S. Provisional Application Ser. No. 62/231,701 is hereby incorporated in its entirety.

BACKGROUND

Analogous to the electronic diode, a thermal diode transports heat mainly in one preferential direction rather than in the opposite direction. Phase change thermal diodes usually rectify heat transport much more effectively than solid state thermal diodes due to the latent heat phase change effect. However, they are limited by either the gravitational orientation or one dimensional configuration. On the other hand, solid state thermal diodes come in many shapes and sizes, durable, relatively easy to construct, and are simple to operate, but their diodicity (rectification coefficient) is always in the order of $\eta \sim 1$ or lower, which is too small for practical applications. In order to be practically useful for most engineering systems, a thermal diode should exhibit a diodicity in the order of $\eta \sim 10$ or greater.

The effectiveness of a thermal diode is measured by the rectification coefficient (diodicity) which is given by, $$\eta = \frac{k_f - k_r}{k_r} \tag{1}$$

where $k_f$ and $k_r$ are the effective thermal conductivities in the forward and reverse operating modes, respectively. When heat transfers in the preferential direction with high conductance, the thermal diode is operating in forward mode. When heat transfers in the opposite direction with low conductance, the thermal diode is operating in reverse mode. To maximize the diodicity, the heat transfer in the forward mode should be maximized, while the heat transfer in the reverse mode should be prevented.

The thermal diode of the present embodiments includes a heat source, a heat sink and a thermal coupling element, which are all metal blocks (i.e. copper, aluminum, and iron). In the forward mode, the thermal coupling element is in contact with the heat source and heat sink. Since metal is a good thermal conductor, a good heat transfer occurs in the forward mode. In the reverse mode, the thermal coupling element is moved out of the thermal contact with the heat source and heat sink. Since air is a good thermal insulator, heat transfer is effectively prevented in the reverse mode.

An electrical motor is a good device for controlling the movement of the metal blocks. However, it requires electrical energy.

Therefore, it is desirable to develop a passive solid thermal diode with a large diodicity.

SUMMARY

In general, in one aspect, the embodiments relate to a passive thermal diode, comprising: a heat source; a heat sink; a thermal coupling element removably coupled to the heat source and heat sink; a lever, the lever connected to the thermal coupling element via a pivot point; and at least one spring connected to the lever, the spring comprised of a shape memory alloy, wherein the lever transmits a force to displace the thermal coupling element when the force is produced by the spring on the lever.

In general, in one aspect, the embodiments relate to a passive thermal diode for controlling heat transfer, comprising: a heat source including a first surface; a heat sink including a second surface; a thermal coupling element that removably contacts the first and second surface, the thermal coupling element having a third surface; a lever having a first and second end, the first end connected to the thermal coupling element, and the second end connected to a pistol assembly; and at least one spring comprised of a shape memory alloy connected to the pistol assembly, wherein the at least one spring is configured to displace the pistol assembly in a first direction running along the center axis of the pistol assembly at a predetermined temperature.

In general, in one aspect, the embodiments relate to a method for operating a passive thermal diode, comprising: providing a heat source; providing a heat sink; providing a thermal coupling element removably coupled to the heat source and heat sink; placing a lever, the lever connected to the thermal coupling element via a pivot point; and placing at least one spring connected to the lever via a pistol assembly, the spring comprised of a shape memory alloy operating to displace the pistol assembly in a first direction running along the center axis of the pistol assembly at a predetermined temperature.

Other aspects of the embodiments will be apparent from the following description and the appended claims.

DETAILED DESCRIPTION

Figure 1A:
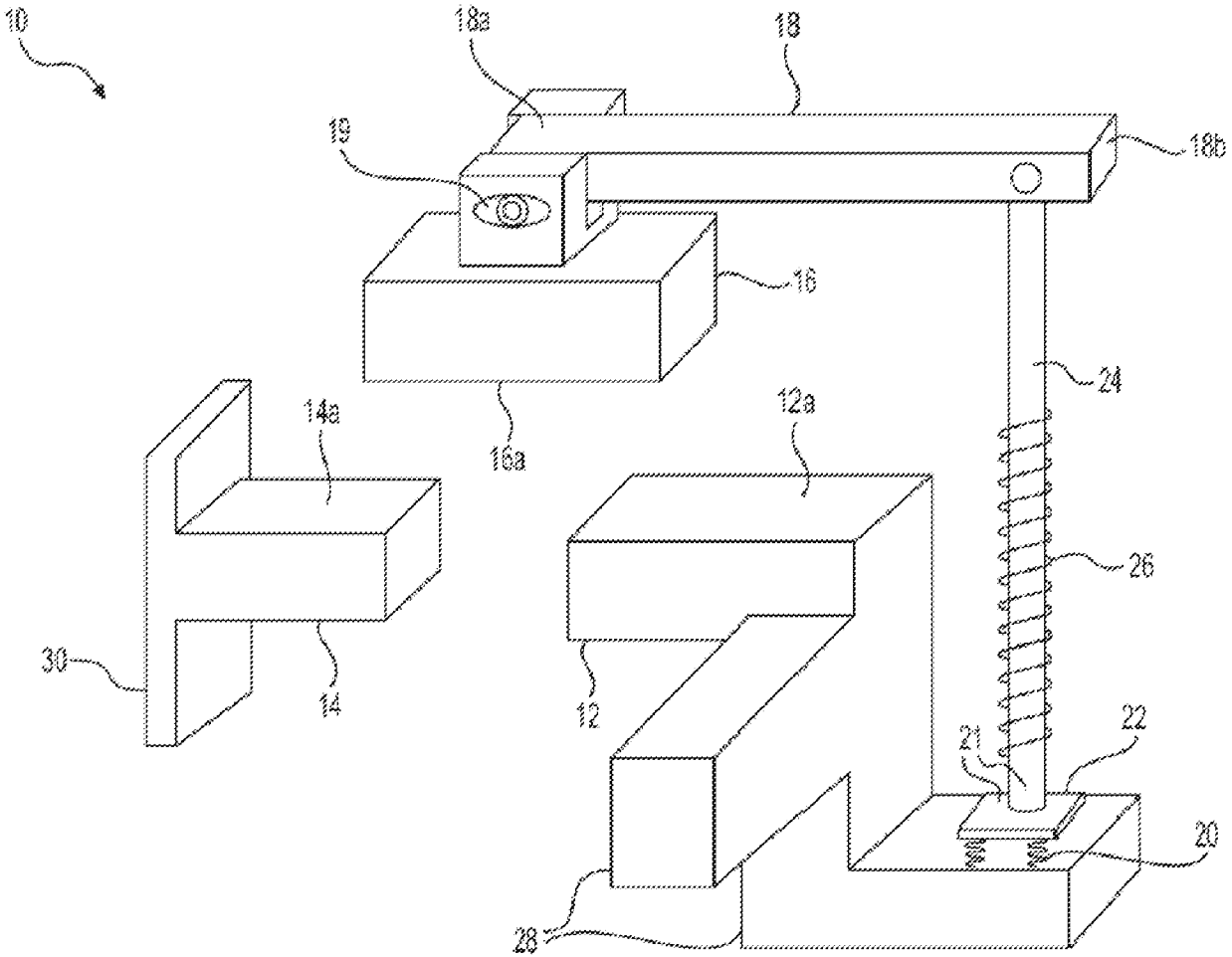
FIG. 1A shows an exemplary thermal diode without a cover system.

Specific embodiments will now be described in detail with reference to the accompanying figures. Like elements in the various figures are denoted by like reference numerals for consistency.

In the following detailed description of embodiments, numerous specific details are set forth in order to provide a more thorough understanding of the embodiments. However, it will be apparent to one of ordinary skill in the art that the embodiments may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, the embodiments discussed herein relate to a device and method for heat transfer controlling. Specifically, at least one spring comprised of a shape memory alloy (SMA) produces a force corresponding to its temperature. The force controls the movement of a thermal coupling element to form or break a heat transfer path in different operating modes.

More specifically, a shape memory alloy is an alloy that remembers its original shape. Such an alloy changes its shape at a predetermined temperature, which is defined as the SMA's activating temperature. When it is heated to a temperature higher than the SMA's activating temperature (i.e., the system is in a hot state), the SMA expands; when it is cold or the temperature is lower than the activating temperature (i.e., the system is in a cold state), the SMA contracts, thereby providing the force and motion required to change the mechanical connection between the heat source/heat sink and the thermal coupling element. By introducing a SMA actuation system to replace the electrical motor, a passive thermal diode is possible. It will now be apparent to one of ordinary skill in the art that the specific SMA may be chosen based on specific desired performance of the SMA to replace the otherwise required electrical motor.

In the embodiments discussed herein, when the SMA is heated to a temperature higher than the activating temperature, the thermal diode is in a hot state, and the thermal diode operates in the forward mode. In contrast to the hot state, when the SMA's temperature is lower than the activating temperature, the thermal diode is in a cold state, and the thermal diode operates in the reverse mode.

FIG. 1A shows an exemplary thermal diode without a cover system. As shown in FIG. 1A, the thermal diode 10 includes a heat source 12 having a corresponding top surface 12*a* and a heat sink 14 having a corresponding top surface 14*a*. The heat source 12 and the heat sink 14 are attached to heat-in member 28 and heat-our member 30, respectively. A thermal coupling element 16 is removably coupled to the heat source 12 and heat sink 14. The thermal coupling element has a bottom surface 16*a*, which is in contact with the heat source surface 14*a* and heat sink surface 14*b* in a forward mode. A lever 18 has two ends with a first end 18*a* connecting to the thermal coupling element via a pivot point 19 and a second end 18*b* connecting the lever 18 to a pistol assembly 21. The pistol assembly 21 comprises a base plate 22 and a pistol rod 24. The pistol rod 24 links the second end 18*b* to the base plate 22. The base plate 22 is linked to at least one shape memory alloy (SMA) spring 20, which is further connected to the heat-in member 28. A bias spring 26 is placed surrounding the pistol rod and placed between the lever 18 and the base plate 22.

Figure 1B:
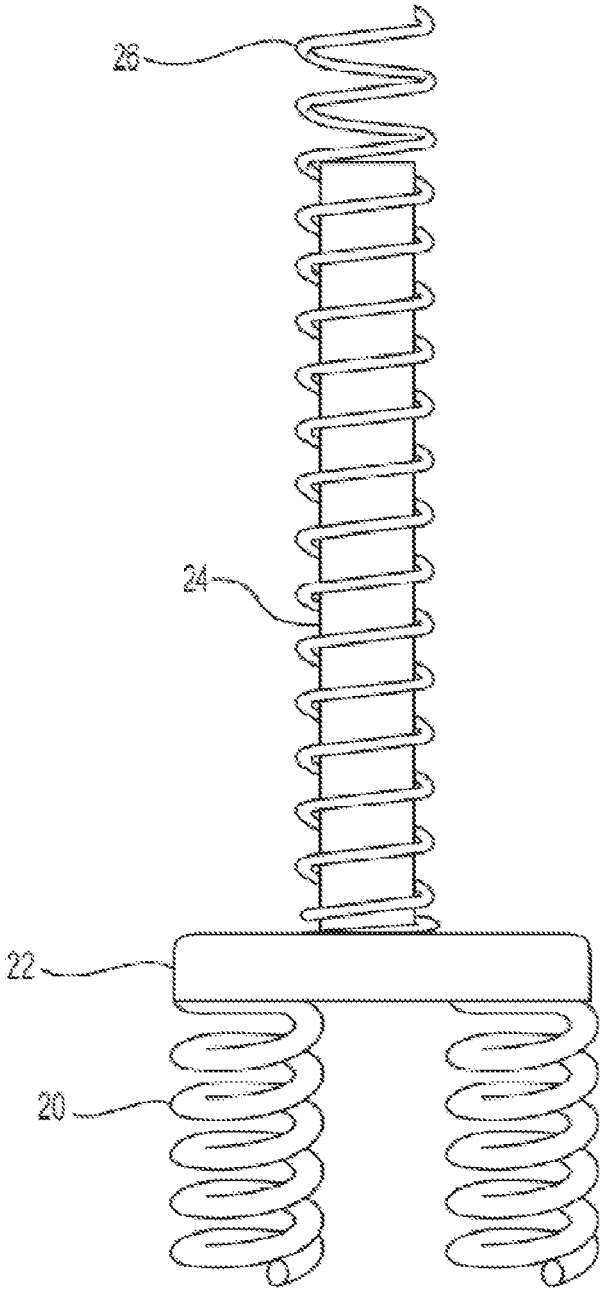
FIGS. 1B and 1C show an exemplary SMA actuation system without and with a case.

FIG. 1B shows an exemplary SMA actuation system without a case. The SMA actuation system includes the at least one SMA spring 20, the base plate 22, the pistol rod 24 and the bias spring 26 placed surrounding the pistol rod. This SMA actuation system provides the force and motion required to change the connection between the heat source and heat sink with the thermal coupling element and further control the heat transfer.

Figure 1C:
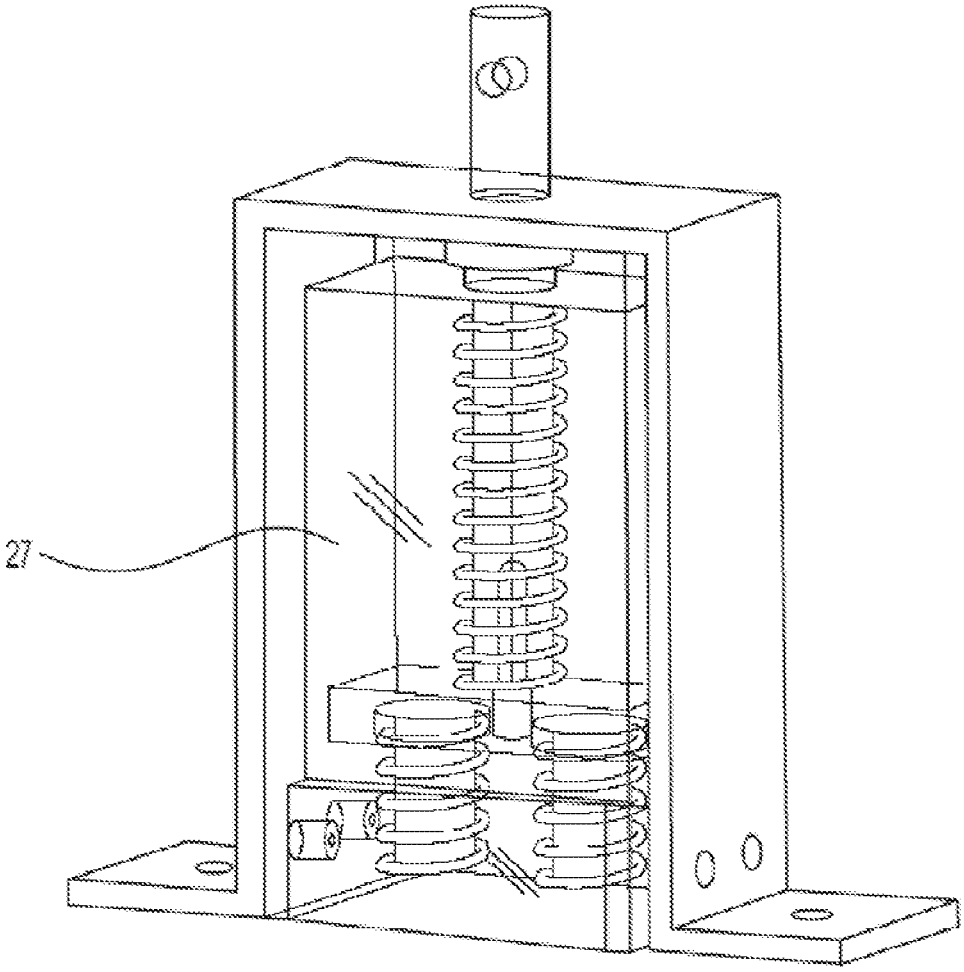

The SMA actuation system may be contained in a case 27 as shown in FIG. 1C. With the case 27 containing the SMA actuation system, the bias spring 26 is able to balance the force from the at least one SMA spring 20, so that the system can reach equilibrium status eventually.

Figure 2:
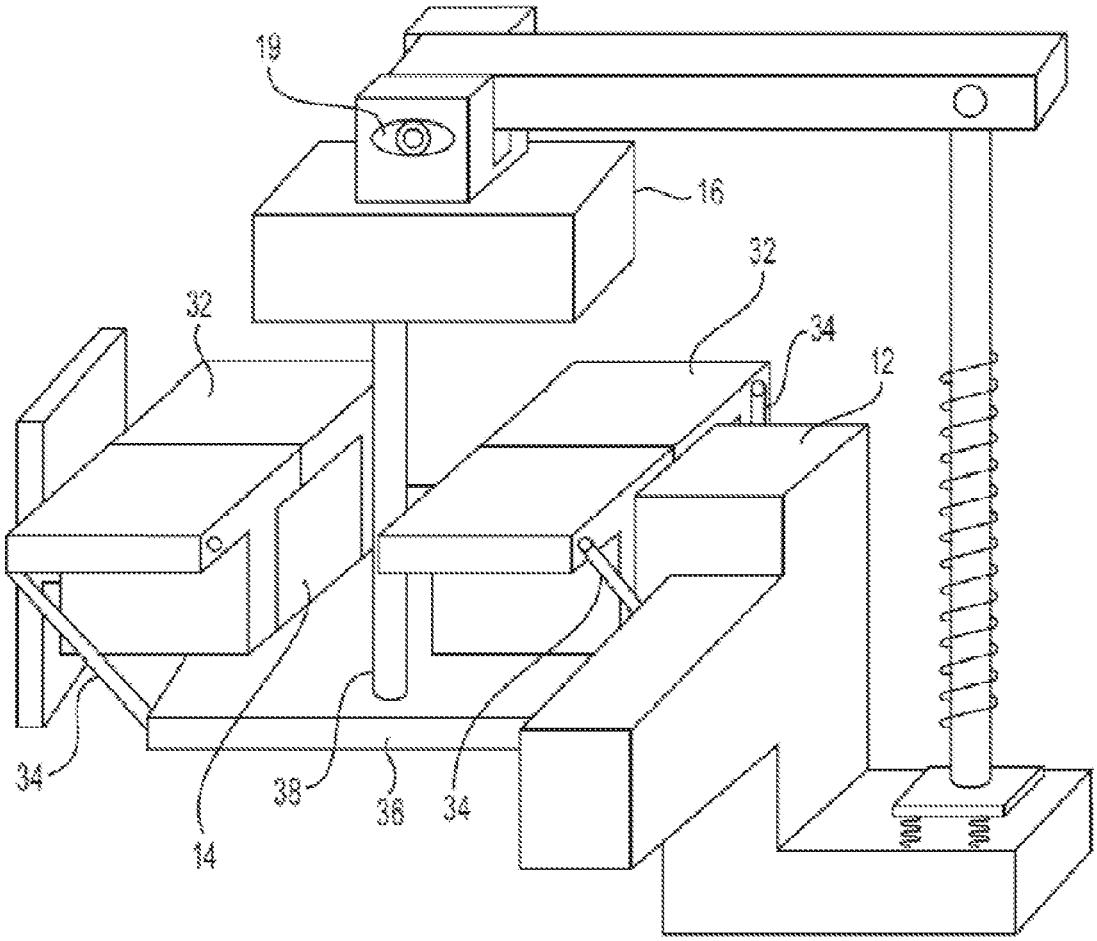
FIG. 2 shows an exemplary thermal diode with a cover system in the reverse mode.

FIG. 2 shows an exemplary thermal diode with cover system in the reverse mode, which is when the SMA's temperature is lower than the activating temperature (i.e., in the cold state). As shown in FIG. 2, a cover system includes at least two cover elements 32 covering both the heat source 12 and the heat sink 14 (preventing the heat exchange between thermal coupling element 16 and both of heat source 12 and heat sing 14) and at least two driving pins 34 that connect the at least two cover elements 32 to a plate 36, which is further connected to the thermal coupling element 16 through a connecting rod 38. In the cold mode, the SMA spring 20 applies an initial force to the pistol assembly, which pulls the second end 18*b*, and consequently lifts up the first end 18*a*. The thermal coupling element 16 is pulled up by the lifting of lever 18 and the movement of first end 18*a*. This upward force applies to the cover system, and closes the at least two cover elements 32. The cover elements 32 are used to prevent heat from transporting through convection and/or radiation from the heat source 12 and heat sink 14 to the thermal coupling element 16. The usage of the cover system is to minimize the effective thermal conductivity in a reverse mode. It should be noted that any materials could be used as the cover elements as long as it has a low thermal conductivity. In present embodiments, the thermal conductivity value below 0.5 W/(mK) is considered to be low. For example, the cover materials could be woods, Polytetrafluoroethylene (PTFE), or any other polymers or plastics having a low thermal conductivity.

Figure 3:
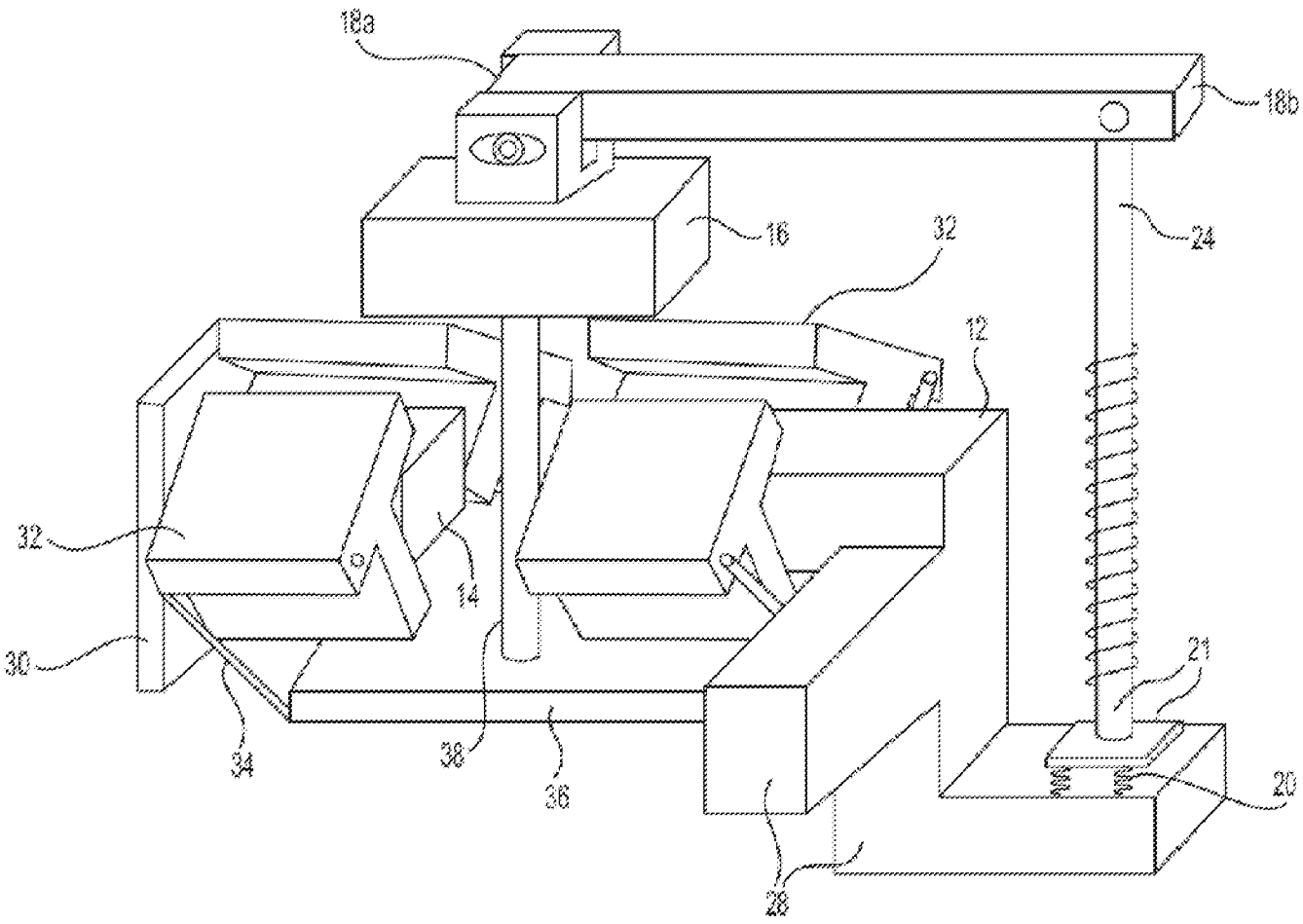
FIG. 3 shows how the thermal diode moving to operate in the forward mode.

FIG. 3 shows how the thermal diode of the present embodiments operates in the forward mode, which is when the SMA is heated to its activating temperature (i.e., in the hot mode). As shown in FIG. 3, the at least one SMA spring 20 elongates, and pushes up the pistol assembly in a direction running along the center axis of the pistol rod 24. Consequently, the second end of the lever 18*b* is displaced in the same direction, and the first end of the lever 18*a* connecting the thermal coupling element 16 is displaced in an opposite direction. The thermal coupling element 16 also moves in a parallel and opposite direction of the movement of the pistol assembly.

Specifically, the force transmitted to the thermal coupling element 16 is applied to the plate 36 through the connecting rod 38 and the cover elements 32 are displaced via the driving pins 34. Thermal coupling element 16 is brought into contact with the heat source 12 and the heat sink 14. A heat transfer path is formed to allow the heat to transfer from the heat-in member 28 to heat-out member 30.

The lever system plays the role of a bridge and magnifies the displacement between the pistol assembly and the thermal coupling element 16. For example, the elongation of the SMA spring 20 may only be a few mm when heated, but the thermal coupling element 16 needs to move a longer distance to touch the heat source 12 and the heat sink 14. For example, the SMA spring may only expand by 3 mm, but the thermal coupling element must move 9 mm to complete the connection between the heat sink and the heat source. It will now be apparent to one of ordinary skill in the art that depending on the specific requirements of a system, different combination and configurations of lever system may be used to allow for different distances required to transition a system between a hot and cold state to operate in a forward or reverse mode, respectively.

Figure 4:
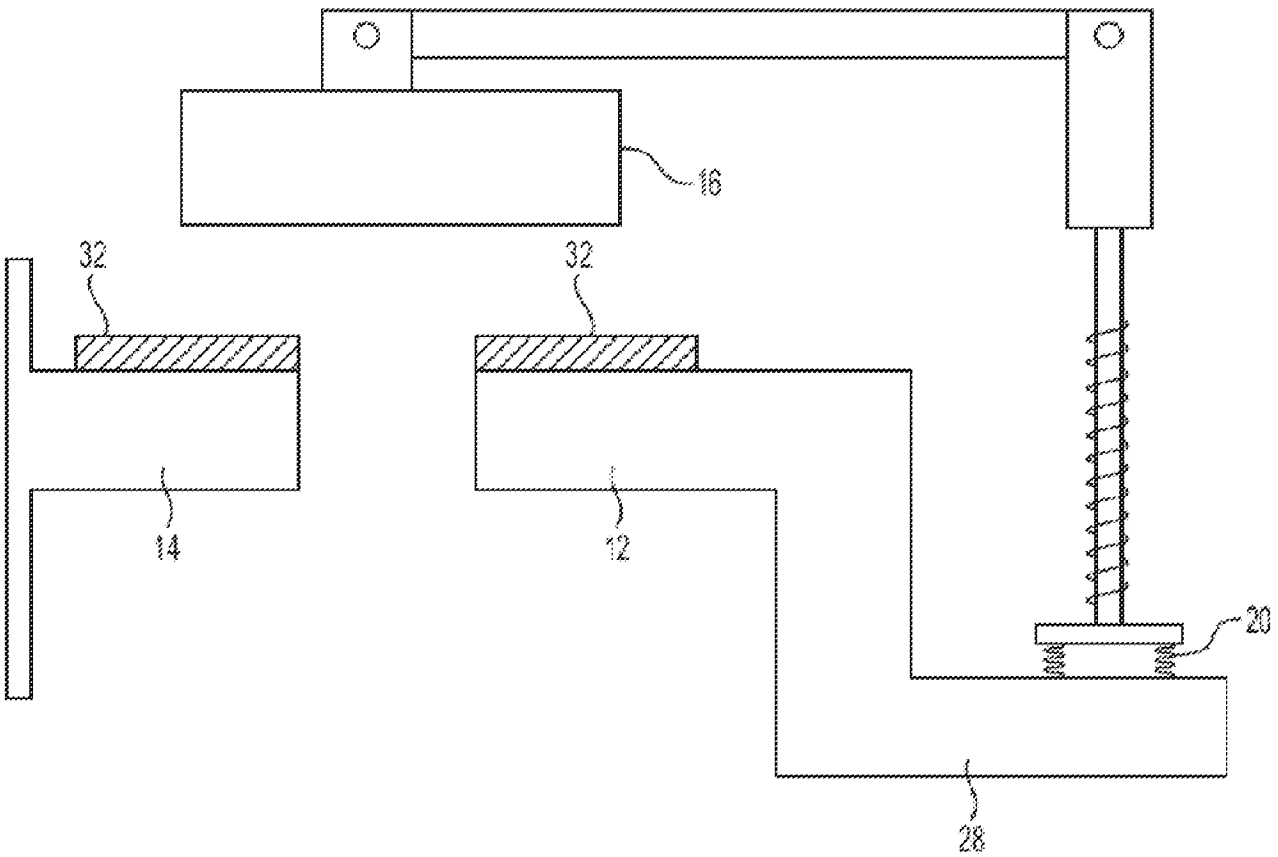
FIG. 4 shows a cross-sectional view of a thermal diode in the reverse mode.

FIG. 4 illustrates a cross-sectional view of the assembly in the reverse mode. In the reverse mode, the temperature of heat-in member 28 is lower than the SMA's activating temperature. The SMA spring 20 is in its original shape, and applies an initial force to the thermal coupling element 16 through the lever 18 and the pistol assembly. The cover elements 32 are closed covering the heat source 12 and heat sink 14. No heat is transferred. In other words, the thermal conductivity is minimized in the reverse mode.

Figure 5:
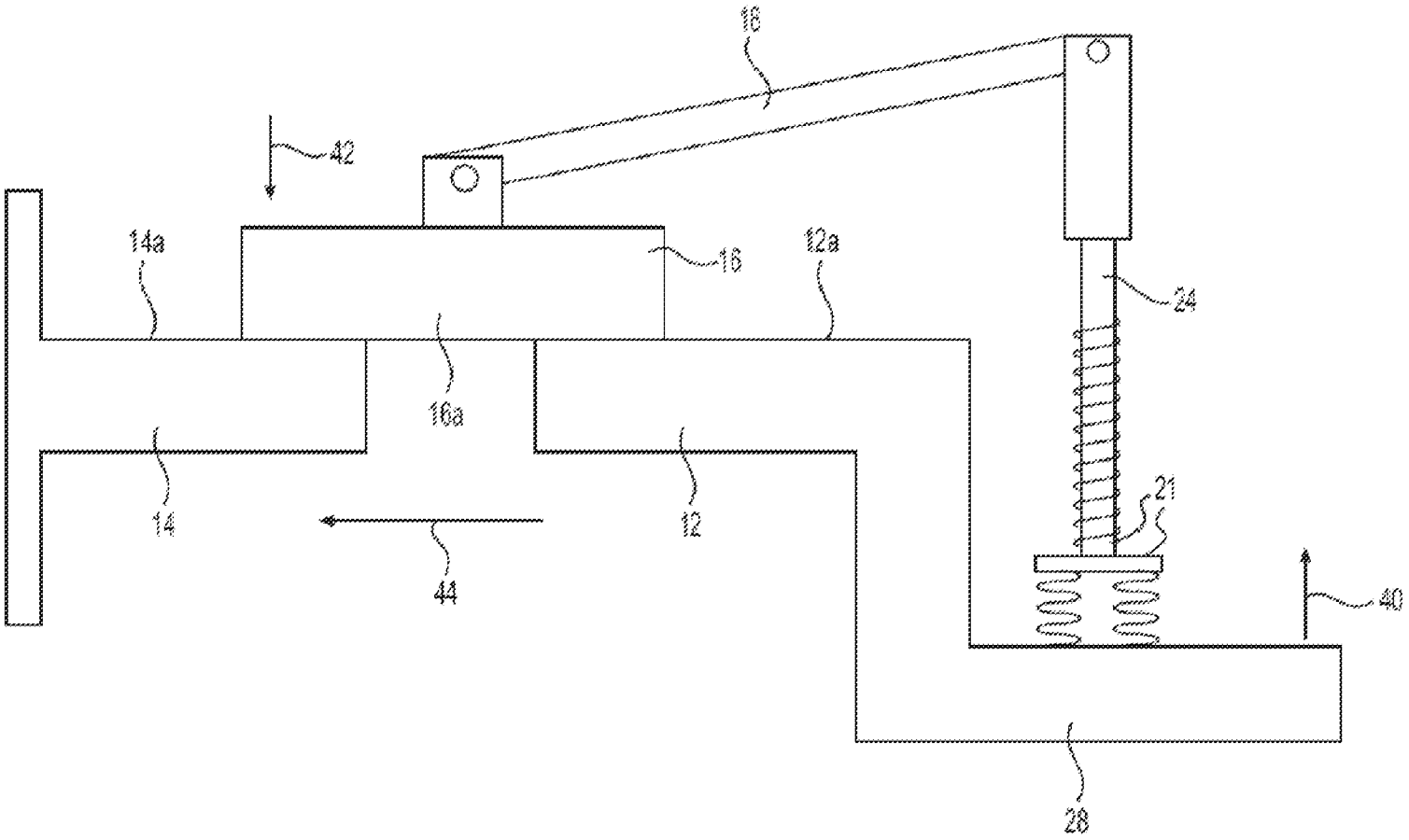
FIG. 5 shows a cross-sectional view of the thermal diode in the forward mode.

FIG. 5 illustrates a cross-sectional view of the assembly in the forward mode. In the forward mode, the heat-in member's temperature increases to higher than the predetermined value. The SMA spring 20 in thermal contact with the heat-in member 28 responds to the high temperature by elongating their lengths, and pushing up the pistol assembly 21 in a direction along the center axis of the pistol rod 24 as illustrated by arrow 40. The force produced by the SMA spring 20 is transmitted through the lever 18 to push down the thermal coupling element 16. Therefore, the thermal coupling element moves in a direction that is parallel and opposite to the direction of pistol assembly 36. The movements of the thermal coupling element 16 are illustrated by arrow 42. The force transmitted to the thermal coupling element is applied to the cover system and moves away the cover elements 32. When the thermal coupling element 16 is in contact with the heat source 12 and the heat sink 14, heat transfers from the heat source 12 to the relatively cool heat sink 14 through the thermal coupling element 16 as illustrated by arrow 44. A high thermally conductively paste, Omega OT-201, could be provided on the surfaces 12*a*, 14*a* and 16*a* to reduce thermal contact resistance.

According to experimental results, the present embodiments develop a passive solid state thermal diode with a large diodicity of 93.24±23.01.

Figure 6:
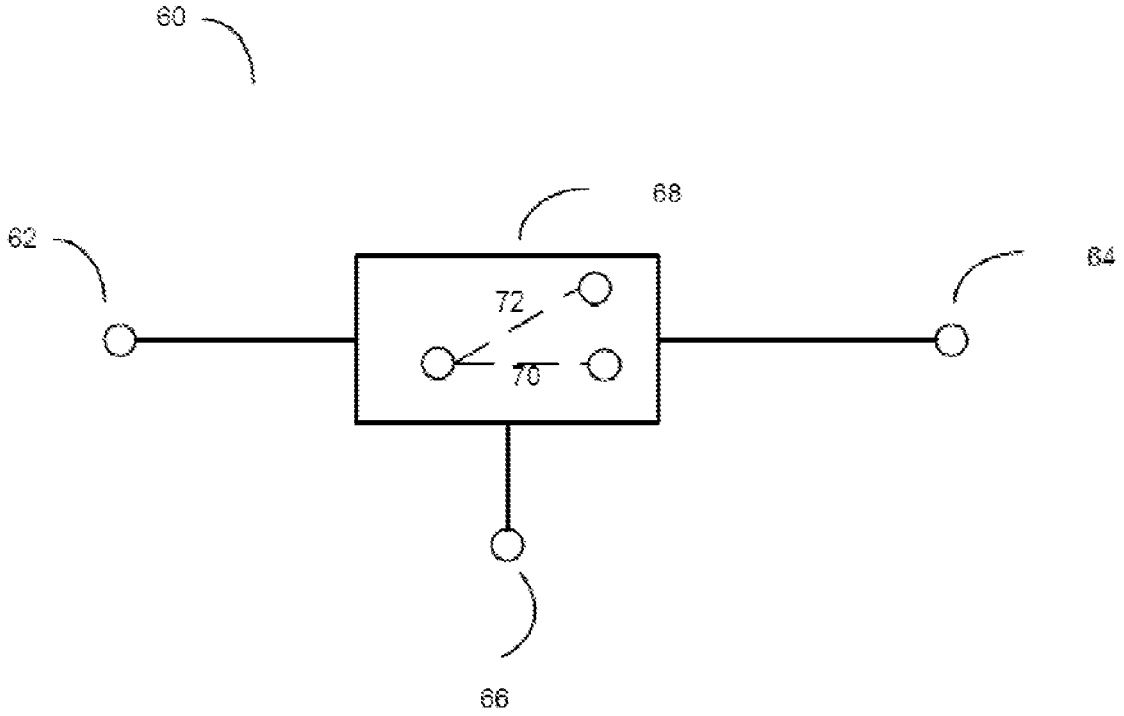
FIG. 6 shows an exemplary thermal switch.

The present embodiments can be extended to develop a thermal switch (60) as shown in FIG. 6. While the operating principle remains the same as the aforementioned thermal diode, the thermal switch actively controls the heat transfer by an "ON/OFF" gate switch (68). The heat can transfer in either direction in the thermal switch, which makes the heat source (12) and heat sink (14) act as two counterparty terminals: first terminal (62) and second terminal (64). There is a third terminal (66) that controls the gate switch (68) to further control heat transfer between the first terminal (62) and second terminal (64). Specifically, the thermal switch decides whether the overall system performs as a conductor or insulator. More specifically, when the gate switch (68) is placed on "ON" mode (70), the heat is allowed to transfer between the first two terminals, and the overall system performs as a conductor; otherwise, the gate switch is placed on "OFF" mode (72) with no heat transfer, and the overall system performs as an insulator.

Taking the thermal diode in FIG. 1 as an example, the heat source (12) and heat sink (14) may be the first and second terminals in the thermal switch. Further, the removable thermal coupling element (16), the lever (18), pistol assembly (21) and the cover system may act as a whole assembly as the gate switch (68) in the thermal switch. In addition, the SMA spring (20) may be the third terminal (66) that controls the movement of the whole assembly by producing two forces in parallel and opposite directions based on the SMA spring's temperature. Specifically, the whole assembly acts as a gate switch (68) on "ON" mode (70) when the SMA is heated to a temperature higher than the activating temperature; and the whole assembly acts as a gate switch (68) on "OFF" mode (72) when the SMA's temperature is lower than the activating temperature. In this example, the thermal diode is a passive control device. However, the thermal switch is an active control device which actively makes the decision whether the overall system performs as a conductor or insulator.

In sum, the thermal switch has the same ability as the thermal diode. However, where the thermal diode is a passive control device, the thermal switch is an active control device. Both thermal switch and thermal diode are applicable to the devices which require thermal rectification. The difference between the thermal switch and the thermal diode only depends on whether an active control or passive control is required.

One advantage of the thermal switch is the ratio of "OFF" state thermal resistance over "ON" state thermal resistance (Roff/Ron) or ratio of "ON" state conductance over "OFF" state conductance. According to experimental results, the SMA based thermal switch can achieve the value of Roff/Ron at about 98.73±20.48. However, it will now be apparent to one of ordinary skill in the art that other variations of the above described embodiment are possible and may result in alternative Roff/Ron ratios required for specific applications.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A passive thermal diode, comprising:
- a heat source;
- a heat sink;
- a thermal coupling element removably coupled to the heat source and heat sink;
- a lever, the lever connected to the thermal coupling element via a pivot point; and
- at least one spring connected to the lever, the spring comprised of a shape memory alloy, wherein
- the lever transmits a force to displace the thermal coupling element when the force is produced by the spring on the lever.

2. The passive thermal diode of claim 1, further comprising a cover system, comprising:
- at least two cover elements;
- at least two driving pins;
- a connecting rod; and
- a plate, wherein the force transmitted through the lever is applied to the plate via the connecting rod, and displaces the at least two cover elements through the at least two driving pins.

3. The passive thermal diode of claim 2, wherein the at least two cover elements comprise a material having a thermal conductivity of less than 0.5 W/(mK).

4. The passive thermal diode of claim 2, further comprising a pistol assembly, comprising:
- a base plate; and
- a pistol rod, wherein the pistol rod links the lever to the base plate, and the base plate is linked to the at least one spring.

5. The passive thermal diode of claim 4, wherein the pistol assembly moves in a direction running along the center axis of the pistol rod that is parallel and opposite to a second direction, the second direction being the direction of the thermal coupling element when the force is produced by the at least one spring.

6. The passive thermal diode of claim 4, further comprising a bias spring placed surrounding the pistol rod and placed between the lever and the base plate.

7. The passive thermal diode of claim 6, wherein the bias spring produces a force that is less than 50% of a force produced by the at least one spring.

8. The passive thermal diode of claim 6, further comprising:

a thermally conductive paste provided on at least three portions of the passive thermal diode, the first portion located on a surface of the heat source; the second portion located on a surface of the heat sink; the third portion located on a surface of the thermal coupling element, wherein the first surface and second surface are located parallel and opposite to the third surface.

9. The passive thermal diode of claim 1, wherein the diode has a diodicity of 93.24±23.01.

10. A passive thermal diode for controlling heat transfer, comprising:

a heat source including a first surface;

a heat sink including a second surface;

a thermal coupling element that removably contacts the first and second surface, the thermal coupling element having a third surface;

a lever having a first and second end, the first end connected to the thermal coupling element, and the second end connected to a pistol assembly; and at least one spring comprised of a shape memory alloy connected to the pistol assembly, wherein the at least one spring is configured to displace the pistol assembly in a first direction running along the center axis of the pistol assembly at a predetermined temperature.

11. The passive thermal diode of claim 10, further comprising a cover system, comprising:

at least two cover element;

at least two driving pin;

a connecting rod; and a plate, wherein when the pistol rod is displaced in a first direction the plate is displaced in an opposite direction.

12. The passive thermal diode of claim 11, wherein the at least two cover elements comprise a material having a thermal conductivity of less than 0.5 W/(mK).

13. The passive thermal diode of claim 11, further comprising a bias spring placed surrounding the pistol rod and placed between the lever and the base plate.

14. The passive thermal diode of claim 13, wherein the bias spring produces a force that is less than 50% of a force produced by the at least one spring.

15. The passive thermal diode of claim 13, further comprising a thermally conductive paste provided on at least three portions, the first portion located on the first surface; the second portion located on the second surface; the third portion located on the third surface; wherein the first surface and second surface are located parallel and opposite to the third surface.

16. The passive thermal diode of claim 10, wherein the diode has a diodicity of 93.24±23.01.

17. A method for operating a passive thermal diode, comprising:

providing a heat source;

providing a heat sink;

providing a thermal coupling element removably coupled to the heat source and heat sink;

placing a lever, the lever connected to the thermal coupling element via a pivot point; and placing at least one spring connected to the lever via a pistol assembly, the spring comprised of a shape memory alloy operating to displace the pistol assembly in a first direction running along the center axis of the pistol assembly at a predetermined temperature.

18. The method of claim 17, further comprising providing a cover system, comprising:

providing at least two cover elements;

providing at least two driving pins;

providing a connecting rod; and providing a plate, wherein when the pistol rod is displaced in a first direction the plate is displaced in an opposite direction.

the force transmitted through the lever is applied to the plate via the connecting rod, and displaces the at least two cover elements through the at least two driving pins.

19. The method of claim 18, wherein the at least two cover elements comprise a material having a thermal conductivity less than 0.5 W/(mK).

20. The method of claim 18, further comprising providing a bias spring placed surrounding the pistol rod and placed between the lever and the base plate.

21. The method of claim 20, wherein the bias spring produces a force that is less than 50% of a force produced by the at least one spring.

22. The method of claim 20, further comprising providing a thermally conductive paste on at least three portions, the first portion located on a surface of the heat source; the second portion located on a surface of the heat sink; the third portion located on a surface of the thermal coupling element; wherein the first surface and second surface are located parallel and opposite to the third surface.

* * * * *